United States Patent [19]

Juillard

[11] Patent Number: 4,545,194

[45] Date of Patent: Oct. 8, 1985

[54] SPINNING METHOD AND APPARATUS FOR PUTTING METHOD TO USE

[76] Inventor: Yves Juillard, 53, Bd Alfred Wallach, 68100, Mulhouse, France

[21] Appl. No.: 604,834

[22] Filed: Apr. 27, 1984

[30] Foreign Application Priority Data

Apr. 29, 1983 [FR] France ..... 83 07292

[51] Int. Cl.[4] ..... D01H 7/892; D01H 7/898

[52] U.S. Cl. ..... 57/400; 57/90; 57/328

[58] Field of Search ..... 57/90, 328, 331, 400, 57/401, 408, 411

[56] References Cited

U.S. PATENT DOCUMENTS

| | | | |
|---|---|---|---|
| 2,926,483 | 3/1960 | Keeler et al. | 57/400 |
| 3,295,307 | 1/1967 | Kyame | 57/408 X |
| 3,611,695 | 10/1971 | Brown | 57/401 |
| 3,786,622 | 1/1974 | Negishi | 57/401 X |
| 4,202,163 | 5/1980 | Turk et al. | 57/411 X |
| 4,222,222 | 9/1980 | Didek et al. | 57/401 X |
| 4,241,571 | 12/1980 | Turk et al. | 57/411 X |
| 4,322,942 | 4/1982 | Fajt et al. | 57/400 X |
| 4,489,540 | 12/1984 | Faure et al. | 57/328 X |
| 4,497,168 | 2/1985 | Kamp | 57/400 X |

FOREIGN PATENT DOCUMENTS

| | | |
|---|---|---|
| 127347 | 3/1901 | Fed. Rep. of Germany . |
| 1477795 | 3/1967 | France . |
| 2242493 | 3/1975 | France . |

*Primary Examiner*—Donald Watkins

*Attorney, Agent, or Firm*—Hayes, Davis & Soloway

[57] ABSTRACT

The present invention concerns a method and apparatus for spinning using fiber bundles selected from a mass of loose fibers. The apparatus essentially consists of means for removing the fiber bundles comprising a perforated belt (8) and a retaining drum (5) enabling one end of the fiber bundles to be positioned in a fixed area (12) for formation of the thread in its initial stage (15). This fixed area comprises a screen beneath which there is disposed a suction device (13). A hollow twisting flyer (14) and a rotating drum (16) connected to a pressure roller (17) ensure that the thread in formation (15) is caused to rotate and move in translation. This apparatus constitutes an improvement upon open end machines.

9 Claims, 5 Drawing Figures

SPINNING METHOD AND APPARATUS FOR PUTTING METHOD TO USE

The present invention concerns a spinning method using bundles of fibers removed from a strand of fibers presently known as a supply strand.

It also concerns an apparatus for putting this method to use.

The development of spinning machines with open ends, currently called "open-end" machines, provides evidence that there is sufficient interest in the manufacture of continuous thread on a large bobbin and in arranging the fibers around the thread in formation, that is to separate them from the supply strand at the beginning of the process.

Apparatus known in the art use a rotating bowl to integrate fibers which have been previously separated from the supply strand into the thread being formed. Initially, these fibers shower down in many directions upon the thread being formed and because of this, may be positioned radially and tangentially, this being the cause of defects called "fagoting" (bunching) which detract from the strength of thread manufacture.

The occurrence of these defects results from two principal factors: on the one hand, to separation of fibers arriving at the rotating bowl and, on the other hand, to the length of the fibers in relation to the diameter of the bowl, the fiber's eventual arrival at the recovery zone, i.e., the area where thread is formed, being contingent upon its length.

When these two factors exceed certain determinate limits, the thread becomes disconnected, i.e., breaks. Moreover, before the thread breaks during formation, its tensile strength may be decreased, so that the thread may have certain defects in uniformity.

To overcome these disadvantages, the present practice is to ensure very fine separation of the fibers introduced into the rotating bowl of open end machines. This division of fibers is generally accomplished by means of a fiber separator of the carding type, which nonetheless tends to shorten and weaken the fibers.

In addition, the use of a centrifugal machine tends to cause bunching and soiling and limits even further the length of fibers which may be used. Moreover, energy consumption increases rapidly with centrifugal machine diameter, especially when using medium and long fibers. Increased rotation speed entails submitting the thread to considerable centrifugal force during the collection process, and it often becomes necessary to limit this speed, to the detriment of production. To encourage the fibers to stick together, the method of using open end machines necessitates, in comparison with traditional machines, using a greater number of fibers per section and a higher torsion for the thread being formed.

The present invention proposes to overcome these many disadvantages by providing a spinning method in which groups or bundles of fiber are removed by means of an extraction device, the bundles of fiber are moved in an axial direction while being held by one end, the other end remaining free, the fiber bundles then undergoing a change in direction, causing the free ends of these fiber bundles to move essentially perpendicularly to the direction of axial displacement, and to be horizontally positioned on the area for thread formation, which thread is caused to both rotate and be axially displaced, the ends of the fiber bundles which were initially held in place being successively freed and integrated with the thread beginning its formation process.

The fiber bundles, which may comprise one or several fibers, preferably are spaced apart in relation to one another. Preferably, the different fiber bundles are horizontally positioned in succession on the thread formation area, for example, by suctioning them through a fixed or movable screen, the ends of the fiber bundles which were initially held in placed being simultaneously freed.

This process therefore permits the fibers, previously positioned in the thread formation area, to be successively moved and to be attached, in turn, to the thread during its initial formation stage, in a manner similar to that used in tradtional spinning. These operations of joining the fibers are spaced apart in time, but all take place at the same point in space, at the point corresponding to the end of the thread being formed. The first phase of this process consists, therefore, of detaching one or more fibers from the supply strand, the second phase consisting of mechanically moving them to the area of thread manufacture.

The two problems presented are on the one hand, the creation of fiber bundles from the supply strand and the control of these bundles in time and in space, i.e., defining the parameters of their motion; and on the other hand, the formation of thread by rotating its end and integrating it with the fiber bundles moved into the thread formation area.

The apparatus according to the invention overcomes these two problems by removing fiber bundles, thereby attaining a high production level by prior positioning of the bundles to eliminate the risk of "bunching" and by avoiding the use of centrifugal machines with all the previously cited disadvantages of open end machines in use up until now.

To attain this, the apparatus for use with the method described above, is characterized by the fact that it comprises supply means to provide a supply strand of fibers, extraction means to remove fiber bundles, to hold them by one of their free ends and to move them in an axial direction, means to impel free ends of the fibers in a direction essentially perpendicular to their direction of displacement, to position them horizontally in the thread formation area and to free the successive ends of the fiber bundles initially held in place, and means to cause the thread being produced to rotate and move in translation.

According to a preferred embodiment, the extraction means comprises a perforated belt, supported by a drum for propelling the fiber bundles and a drum for retaining them. It may also comprise a pressure roller disposed opposite the drum for maintaining the fiber bundles in position and disposed to be in contact with the perforated belt.

The means for propelling the free ends of the fiber bundles, to position them horizontally in the area of thread formation and to free them, may comprise a fixed or movable screen disposed below the retaining drum and a suction means disposed below said screen. The retaining drum is preferably provided with radial openings connected to a bellows.

The device to produce rotation and displacement of the thread being produced preferably comprises a hollow twisting flyer, as well as a drive drum opposing a pressure drum.

According to a variation, the means for extracting fiber bundles by one of their ends may comprise two or more gripping plates and an eccentric drive pulley for controlling the gap between the plates, to momentarily retain one end of the fiber bundles, and an air nozzle to position the fibers essentially parallel to the axial direction of the thread being formed.

This apparatus, in which simultaneous rotation and axial displacement of the thread being formed are effected, corresponds to traditional spinning machines which produce a regular, well coiled thread having uniform resistance.

Torsion devices, as well as friction devices, are well known, inexpensive and energy efficient. It is easily possible to attain speeds in the order of 500,000 rotations per minute, so that production is limited only by speed of fiber separation. Since fiber separation is accomplished by extraction of fiber bundles, it is quite effective, so that ultimately, thread production is never slowed by the fiber separation process.

A further advantage of this method and apparatus arises from the fact that all sorts of defects may be eliminated from the fiber bundles during transfer, particularly short fibers or surface slubs, thereby resulting in a combed or semi-combed thread. Finally, to obtain specialized threads it is possible to integrate the process of removing defects from the fiber bundles with the process of thread manufacture.

This process enables manufacture of core threads, presently known as "core yarn", by helicoidially winding fiber bundles around the central core of an exterior bobbin. Another advantage of this method arises from the fact that it is possible to stop and start the machine without causing start-up problems well known with open end machines using turbines.

The present invention will be better understood with reference to the description of one example of an embodiment thereof and to the attached drawings, in which.

Figure 1:
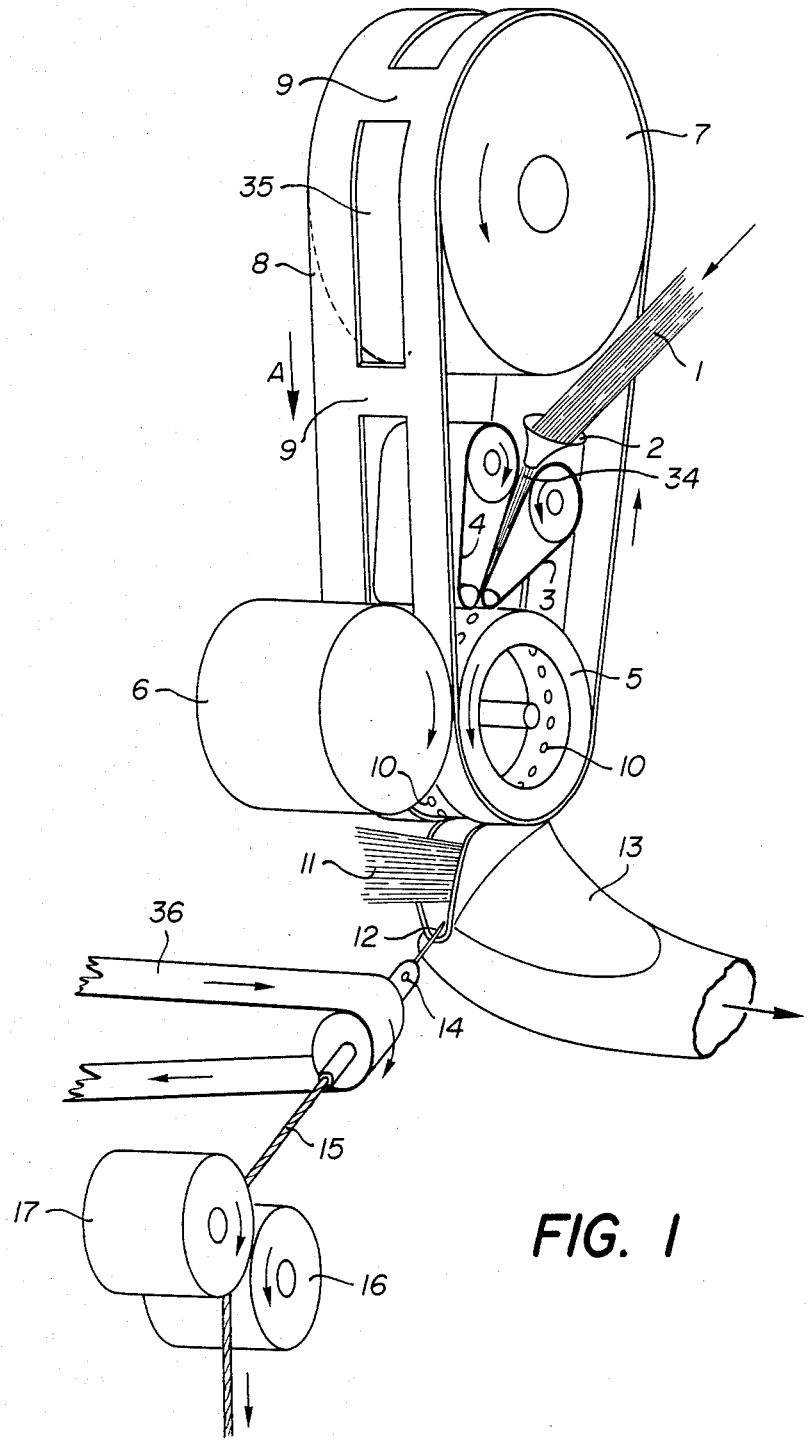
FIG. 1 shows a perspective of a preferred embodiment of the apparatus according to the invention.
Figure 2:
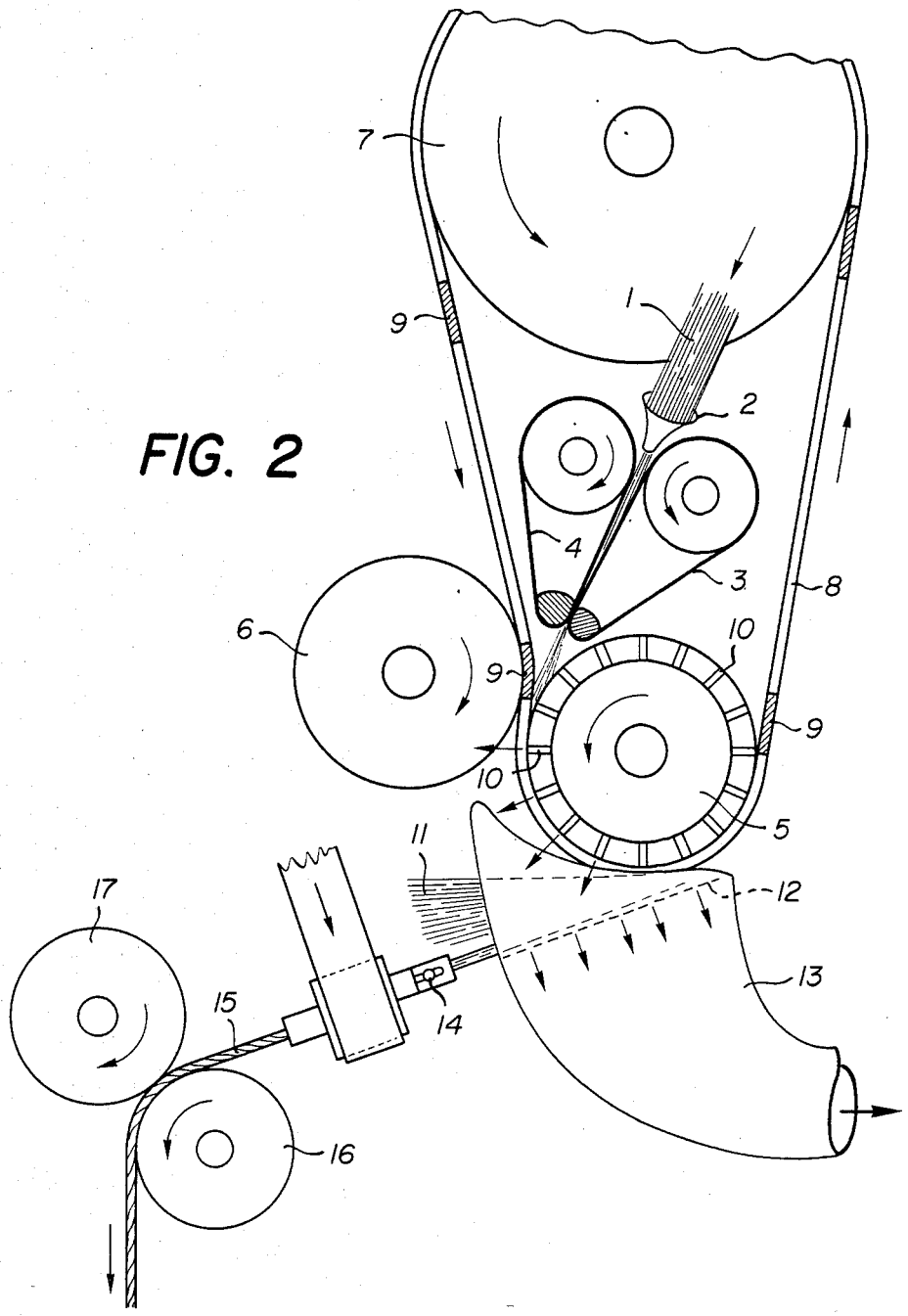
FIG. 2 shows a plane view of the apparatus of FIG. 1.

With reference to FIGS. 1 and 2, the supply means may be of any known type and comprises, for example, a strand of fibers 1 fed through a funnel or hopper 2 between two supply belts 3 and 4 defining a removal area 34, which transports the strand. Fiber bundles are extracted by the removal means comprising a drum or cylinder 5, either retaining or rotating, and a perforated belt 8 positioned between cylinder 5 and drive cylinder 7. Pressure cylinder 6, disposed accross from cylinder 5, is in contact with the exterior surface of perforated belt 8. This belt is provided with two openings 35, which may be, for example, rectangular and of a length at least equal to tne fiber length, separated by crosspieces 9. By appropriate propulsion speeds, the fiber bundles are removed or retained by one end, between belt 8 and retaining drum 5, while the other end, passing through notches 35, is free. Retaining drum 5 preferably comprises radial openings 10 which may be connected to a bellows, which, in conjunction with centrifugal force, causes free ends 11 of the fibers to follow a course essentially perpendicular to the direction of displacement shown by arrow A, these fibers being horizontally positioned on area 12 which, as is more precisely shown in FIG. 2, constitutes a screen below which there is a suction means 13. At the same time that the fibers are horizontally positioned in thread formation area 12, their initially retained ends are freed so that they may join the thread being formed, which is twisted by means of a torsion flyer 14 caused to rotate by a belt 36 and to be axially displaced by two drums 16 and 17, one of which, for example drum 16, is a drive drum and the other, drum 17, is a pressure drum.

Setting the thread in motion is accomplished in a manner known in the art by means of a grooved needle or an angled, oblique extremity, a hollow or bored needle, or by means of a rotating suction device or by rotating the thread with friction.

Figure 3:
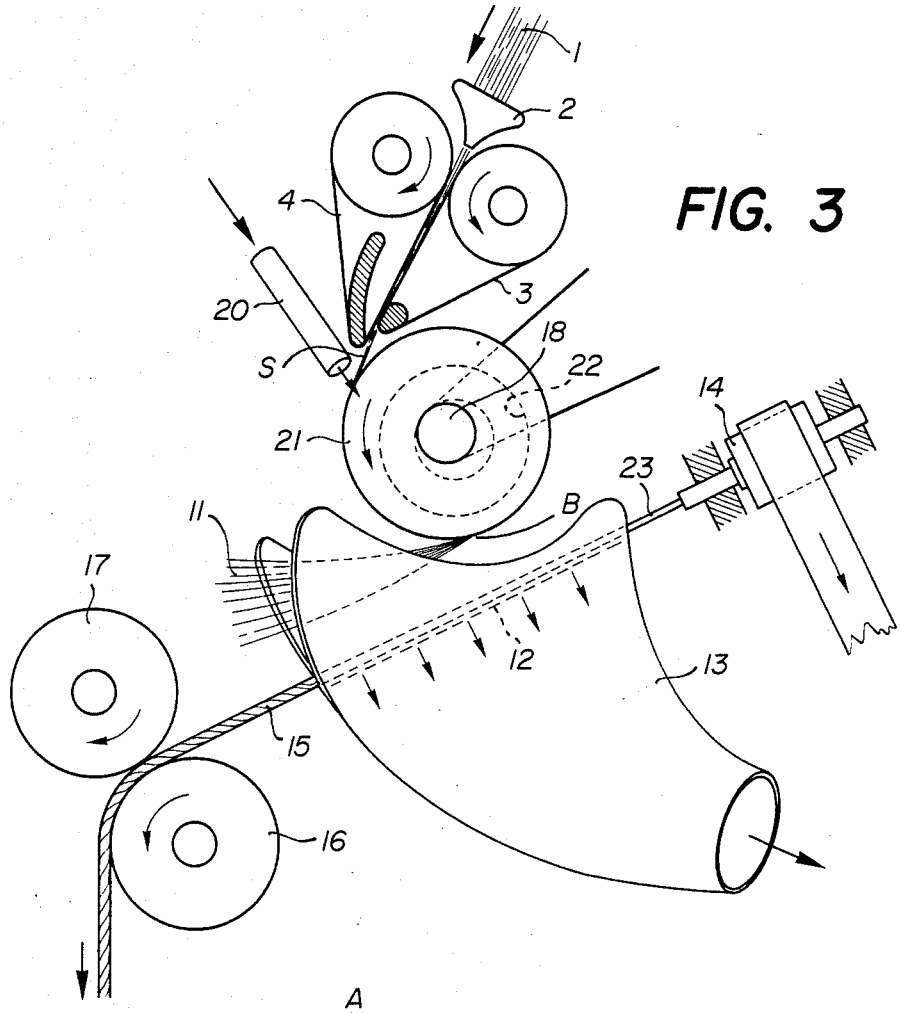
FIG. 3 shows a schematic view of another embodiment of the apparatus according to the invention.
Figure 4:
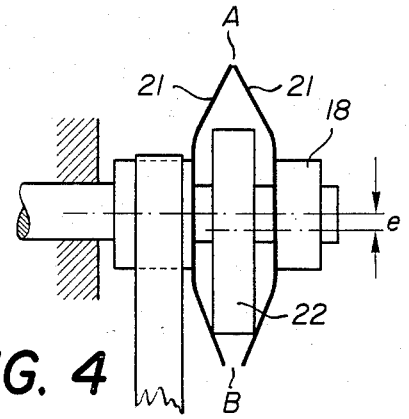
FIGS. 4 and 5 show a detailed elevation and a plane view of a portion of the apparatus of FIG. 3.
Figure 5:
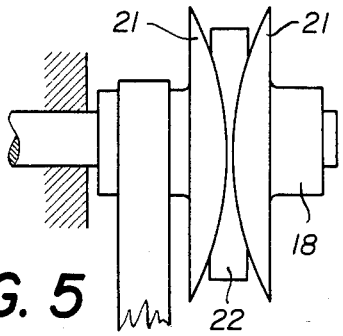

In the embodiment illustrated in FIG. 3, the apparatus comprised of a perforated belt and cylinder shown in FIGS. 1 and 2 has been replaced by an extraction disc 18, comprising two side plates 21 and 22, (shown in FIGS. 4 and 5), mutually angled and turning simultaneously. A compressed air nozzle 20 directs the anterior end of the fiber bundles towards the inside of disc 18 between side plates 21. An eccentric pulley 22, the eccentricity e of which is shown in FIG. 4, separates side plates 21 and periodically frees the fibers at a given point, which may be controlled as a function of pulley position. The final effect is identical to that obtained by the apparatus of FIGS. 1 and 2. Fibers 11, gripped by disc 18 at the outlet 5 of belts 3 and 4 for transporting the strand, are forced against screen 12 which constitutes the area of thread formation and, simultaneously, released at B to become laterally integrated with thread 15 in formation, caused to rotate by a grooved needle 23 integral with hollow twisting means 14.

This system, which allows the gripping site to change location, could be perfected by the combination of any number of side plates each comprising a different gripping site, the different sites being spaced apart from each other.

The present invention is not limited to the embodiments described, but may undergo various modifications and may assume various forms obvious to one skilled in the art.

I claim:

1. Spinning method using fiber bundles selected from a strand of fibers, characterized by the fact that fiber bundles are extracted by means of a removal device, and by the fact that these fiber bundles are caused to move in an axial direction while one of their ends is held in place, the other end remaining free, and by the fact that these fiber bundles are caused to undergo a change of direction in relation to their direction of displacement to impel the free ends of these fiber bundles in a direction essentially perpendicular to the direction of their axial displacement, and to position them horizontally in the area of thread formation, the thread being caused to rotate and to move in translation, and by the fact the the ends of the fiber bundles initially held in place are successively freed so that they become integrated with the thread in formation.

2. Method according to claim 1, characterized by the fact that the fiber bundles are spaced apart from each other.

3. Method according to claim 1, characterized by the fact that the fiber bundles are horizontally positioned on a fixed area for thread formation by creating a pressure differential between the two sides of this fixed area, and by the fact that the ends of the fiber bundles being held in place are simultaneously freed.

4. Apparatus according to claim 1, characterized by the fact that it comprises supply means (3, 4) to furnish a supply strand of fibers, gripping means (5, 8 or 18, 21) to extract fiber bundles, to hold them by one end and to cause them to move in an axial direction, means (3) to propel the free end of the fibers in a direction essentially perpendicular to their direction of displacement, to position them horizontally on an area (12) for formation of thread (15) and to successively free the ends of the fiber bundles initially held in place, and means (14, 16, 17) to cause the thread in formation (15) to rotate and move in translation.

5. Apparatus according to claim 4, characterized by the fact that the gripping means comprise a perforated belt (8) suspended between a drum (7) for driving the fiber bundles and a drum (5) for retaining the fiber bundles.

6. Apparatus according to claim 5, characterized by the fact that it also comprises a pressure roller (6) disposed across from the drum (5) for retaining the fiber bundles and disposed to be in contact with the perforated belt (8).

7. Apparatus according to claim 4, characterized by the fact that the means for moving the free ends of the fiber bundles forward, for horizontally positioning them in the area of thread formation and for freeing them comprises a screen (12) disposed beneath the retaining drum and a suction device (13) disposed beneath said screen, and by the fact that the retaining drum (5) comprises radial openings (1) connected to a bellows.

8. Apparatus according to claim 4, characterized by the fact that it comprises a hollow tube (14) for twisting the thread in formation (15) and a drive drum (16) opposed by a pressure drum (17) to cause the thread in formation (15) to move in translation.

9. Apparatus according to claim 4, characterized by the fact that the means for gripping the fiber bundles by one end comprises at least two gripping side plates (21) and at least one eccentric pulley (22) controlling distance between the side plates, to momentarily retain one end of the fiber bundles, and an air nozzle (20) to direct the fibers between the gripping side plates.

* * * * *